US005259788A

United States Patent [19]

Nishimura et al.

[11] Patent Number: 5,259,788

[45] Date of Patent: Nov. 9, 1993

[54] CONNECTOR FOR WIRING IN A VEHICLE

[75] Inventors: Katsuhiko Nishimura, Hikone; Kouichi Ogawa, Shiga, both of Japan

[73] Assignees: The Furukawa Electric Co., Ltd., Tokyo; Omi Densen Kabushiki Kaisha, Shiga, both of Japan

[21] Appl. No.: 7,803

[22] Filed: Jan. 22, 1993

Related U.S. Application Data

[63] Continuation of Ser. No. 792,197, Nov. 13, 1991, abandoned.

[30] Foreign Application Priority Data

Nov. 14, 1990 [JP] Japan ..... 2-119135[U]
Nov. 14, 1990 [JP] Japan ..... 2-119136[U]

[51] Int. Cl.[5] ..... H01R 13/74

[52] U.S. Cl. ..... 439/565; 439/555; 248/27.3

[58] Field of Search ..... 439/552-558, 439/565; 248/27.3

[56] References Cited

U.S. PATENT DOCUMENTS

| | | | |
|---|---|---|---|
| 2,756,403 | 7/1956 | Francis et al. | 439/552 |
| 3,430,188 | 2/1969 | Leach | 439/555 |
| 3,439,312 | 4/1969 | Greasley | 439/555 |
| 3,731,260 | 5/1973 | Nardone et al. | 439/548 |
| 4,711,507 | 12/1987 | Noorily | 439/557 |

FOREIGN PATENT DOCUMENTS 909417 10/1962 United Kingdom .

*Primary Examiner*—Gary F. Paumen
*Attorney, Agent, or Firm*—Nikaido, Marmelstein, Murray & Oram

[57] ABSTRACT

Disclosed is a connector for wiring in a vehicle that incorporates: a connector body consisting of either a male or a female connector attached to a terminal end of a harness; engagement projections formed on the periphery of the connector body and engaging with at least the two side edges of a hole in a vehicle panel; and a movable piece pressed into contact with the inside surface of the hole in the vehicle panel. Due to the repulsion spring force thereof, the movable piece thereby firmly engages the engagement projections with the hole in the vehicle panel.

6 Claims, 6 Drawing Sheets

CONNECTOR FOR WIRING IN A VEHICLE

This application is a continuation of application Ser. No. 07/792,197 filed Nov. 13, 1991, now abandoned.

BACKGROUND OF THE INVENTION

1. Field of the Invention

The present invention relates to a connector for wiring in a vehicle, and more particularly, to a vehicle wiring connector which can be firmly attached to a vehicle panel by a simple operation.

2. Description of the Related Art

Typical of the connectors conventionally used for wiring in automobiles are the pair of connectors as shown in FIG. 15, wherein one connector 35 is attached to a terminal end of a harness W and the other connector 40 is attached to a terminal end of a harness W'. When wiring-up the automobile, the harness W is passed through a grommet 30 and a silencing cap 31 and thereafter, fitted in the front end opening portion of the grommet 30. The grommet 30 is fitted in a hole "a" in the vehicle panel "A" and a sound baffle/silencing cap 31 is fitted into the front end opening of the grommet 30. Thereafter, the connector 35 and the connector 40 disposed away from the vehicle panel "A" are electrically connected.

Another known pair of connectors is shown in FIG. 16, wherein one connector 35 attached to a terminal end of a harness W has forwardly inclined latching arms 36, 36 provided with engagement protrusions 36*a*, 36*a*, and the other connector 40 is attached to a terminal end of a harness W'. A grommet 30 is fitted around the periphery of the rear end of the connector 35.

The engagement protrusions 36*a*, 36*a* of the latching arms 36, 36 provided on the connector 35 are forcibly pressed into a hole "a" in the vehicle panel "A", to thereby simultaneously attach the connector 35 and the grommet 30 to the vehicle panel "A", and thereafter, the connector 40 is connected to the connector 35.

In the connector shown in FIG. 15, however, a problem arises in that the work involved in fitting the grommet 30 into the hole "a" in the vehicle panel "A", and fitting the sound baffle 31 to the grommet 30, and further, the work involved in connecting the connectors 35 and 40 attached to the harnesses W and W' disposed away from the vehicle panel "A", all require two hands. This is troublesome and takes a long time.

In the connector shown in FIG. 16, however, the grommet 30 and the connector 35 are fitted simultaneously to the vehicle panel "A" by press-fitting the engagement protrusions 36*a*, 36*a* formed at the front ends of the latching projections 36, 36 provided on the connector 35 into the hole "a" in the vehicle panel "A". Thus, the connecting of the connectors 35 and 40 with this type of structure can be done with one hand, and accordingly, work efficiency is improved. Nevertheless, with the connection shown in FIG. 16, if a mechanical pushing force, etc., is exerted in the axial direction on the connector 35, the connector 35 is very easily detached from the vehicle panel "A".

SUMMARY OF THE INVENTION

An object of the present invention is to provide a vehicle wiring connector which allows superior work efficiency in its connection and which is able to be securely and firmly attached to the vehicle panel.

To achieve the above-mentioned object, the present invention provides a first connector for wiring in a vehicle comprising: a connector body consisting of a male or a female connector attached to a terminal end of a harness; engagement projections formed at the outer wall surface of the connector body and engageable with the two side edges of a hole made in an vehicle panel; and an upwardly inclined movable piece formed at the outer wall surface of the connector body and pressed into contact with the inside surface of the hole in the panel by a repulsion spring force thereof to thereby engage the engagement projections with the hole in the vehicle panel.

Preferably, the grommet (e.g., a rubber grommet) is attached to the periphery of one of the connector bodies.

According to the first connector of the invention, the engagement projections of the connector body engage with the two side edges of the hole in the vehicle panel, the upwardly inclined movable piece is pressed into contact with the inside surface of the hole in the panel, and due to the repulsion spring force thereof, the engagement projections are securely and firmly engaged with the edges of the hole in the vehicle panel.

Further, to achieve the above-mentioned object, the present invention provides a second connector for wiring in a vehicle comprising: a connector body consisting of a male or a female connector attached to a terminal end of a harness; engagement projections formed at the outer wall surface of the connector body and engageable with the two side edges of a hole made in a vehicle panel; a movable piece formed at the outer wall surface of the connector body and pressed into contact with the inside surface of the hole in the panel; a locking key insertion portion formed under the movable piece; and a locking key to be inserted into the locking key insertion portion to lock the movable piece and firmly engage the engagement projections with the hole in the vehicle panel.

Preferably, the movable piece is provided with a repulsion spring force sufficient to press the movable piece into contact with the inside surface of the hole in the vehicle panel to thereby firmly engage the engagement projections with the hole in the vehicle panel.

Also, preferably the movable piece is provided with a stopper projection formed at the base end thereof, such that the front end of the locking key abuts against the stopper projection.

A grommet, preferably a rubber grommet, is attached to the periphery of one of the connector bodies.

In the second connector according to the invention, the engagement projections of the connector body engage with the two side edges of the hole in the vehicle panel, and the movable piece is pressed into contact with the inside surface of the hole in the vehicle panel. Then, to the repulsion spring force of the movable piece, the engagement projections are firmly engaged with the two side edges of the hole in the vehicle panel. Thereafter, locking key is inserted into the locking key insertion portion, to thereby stop any movement of the movable piece to thus securely and firmly fix the connector to the vehicle panel. Also, if the connector is not properly attached to the vehicle panel, the front end of the locking key abuts against the stopper projection provided at the base end of the movable piece, and thus cannot be fully inserted into the locking key insertion portion. Accordingly, it can be detected that the connector is not properly attached to the vehicle panel.

Further, the rubber grommet is fitted tightly to the vehicle panel, and thus prevents the entry of noise, rain water, and dust, etc., from the engine compartment to the passenger compartment of the vehicle.

BRIEF DESCRIPTION OF THE DRAWINGS

Other objects and features of the present invention will be described in detail with reference to the accompanying drawings, in which.

DESCRIPTION OF THE PREFERRED EMBODIMENTS

An explanation will now be made of a first embodiment of the present invention, with reference to the drawings.

Figure 1:
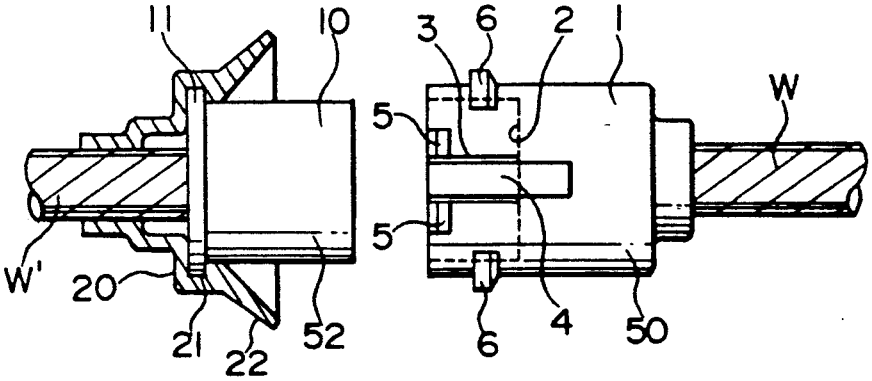
FIG. 1 is a disassembled view of a pair of connectors according to a first embodiment of the present invention.
Figure 2:
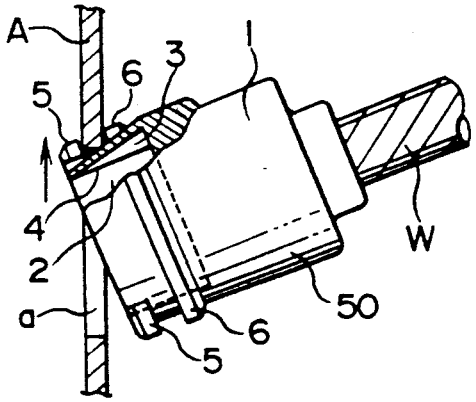
FIG. 2 and FIG. 3 are explanatory views showing the assembly of the connector of the first embodiment.
Figure 3:
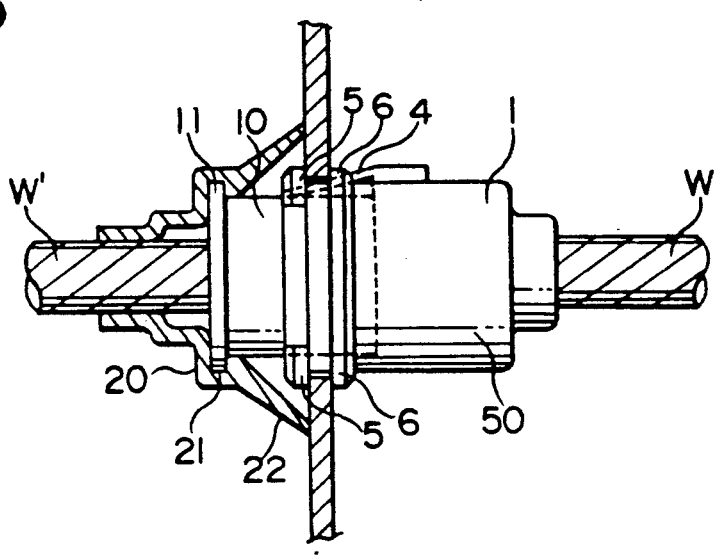
Figure 4:
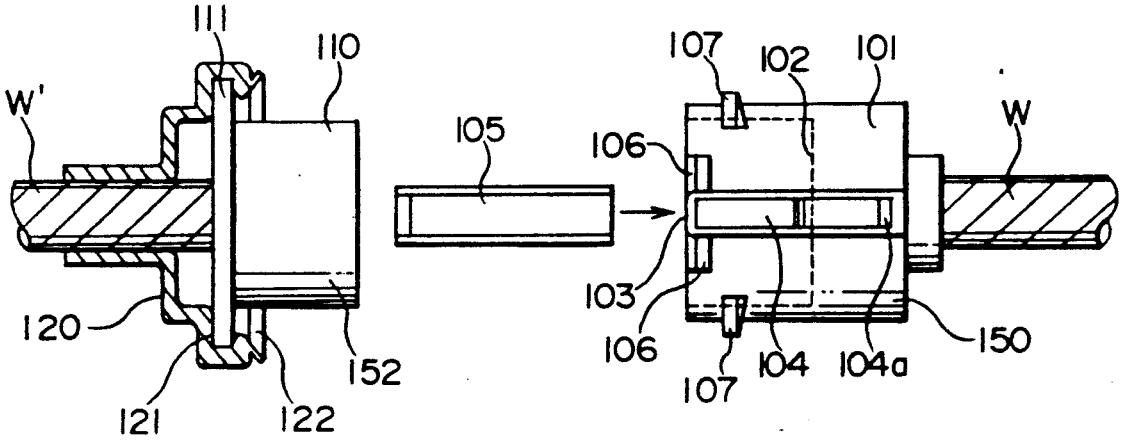
FIG. 4 is a disassembled view of a pair of connectors according to a second embodiment of the present invention.

In FIGS. 1 to 3, 1 is a female connector comprised of a connector body 50, 2 is a fitting hole in which the front end of the opposing male connector 10 is fitted, 3 is a cutaway portion opening into the fitting hole 2, and 4 is an upwardly inclined movable piece vertically and movably supported at the outer wall surface of end of the cutaway portion 3. The upwardly inclined movable piece 4, as shown in FIG. 2, is pressed into contact with the inside surface of a hole "a" in a vehicle panel "A", and due to a repulsive spring force thereof, causes later-mentioned engagement projections 5 and 6 to be fully engaged with the two side edges of the hole "a" in the panel. Reference numerals 5 and 6 show engagement projections formed at the front end of the connector body 50. The engagement projections 5 and 6 are designed in such a manner that they are engaged with the two side edges on both sides of the hole "a", respectively, in the vehicle panel "A".

The connector body 50, the engagement projections 5 and 6, and the upper inclined movable piece 4 are formed as a single body from a synthetic resin.

Note, the positions at which the upwardly inclined movable piece 4 and the engagement projections 5 and 6 are provided are not limited, and the design may be modified according to need.

Reference numeral 10 denotes a male connector comprised of a connector body 52 and a flange portion 11 provided at the outer peripheral surface of the rear end of the connector body 52.

Further, reference numeral 20 denotes a rubber grommet. The rubber grommet 20 is provided with a fitting groove 21 which fits detachably over the flange portion 11 provided at the outer peripheral surface of the rear end of the male connector 10 and has a suction cup shaped tight-fitting portion 22 formed at the front end.

According to this embodiment of the connector of the present invention, when connecting, for example, a harness W disposed at the passenger compartment side and a harness W' disposed in the engine compartment, as shown in FIG. 2, the female connector 1 is connected to the terminal end of the harness W disposed in the passenger compartment, is inclined to press the front end of the upwardly inclined movable piece 4 into contact with the inside surface of the hole "a" in the vehicle panel "A" to thereby bend the upwardly inclined movable piece 4 and force it inside the cutaway portion 3, or the upwardly inclined movable piece 4 can be manually forced into the cutaway portion 3, and accordingly, the engagement projections 5 and 6 are engaged with the two side edges of the hole "a" in the panel A. Therefore, as shown in FIG. 3, due to the repulsion spring force of the upwardly inclined movable piece 4 in press contact with the inside surface of the hole "a" in the vehicle panel "A", the engagement projections 5 and 6 are firmly engaged with the two side edges of the hole "a" in the vehicle panel A.

Next, the male connector 10 attached to the grommet 20 is inserted into the fitting hole 2 of the female connector 1, whereby the harness W disposed in the passenger compartment and the harness W' disposed in the engine compartment are electrically connected, and the suction cup shaped tight fitting portion 22 provided at the front end of the grommet 20 is tightly adhered to the vehicle panel "A", to thereby completely prevent the entry of noise, rain water, and dust, etc., from the engine compartment to the passenger compartment of the vehicle. At the same time, any movement of the upwardly inclined movable piece 4 provided in the female connector 1 is prevented by the outer wall surface of the male connector 10, as shown in FIG. 3, and therefore, the female connector 1 is securely and firmly fixed to the vehicle panel "A", and will not be detached therefrom even if a mechanical tensile force, etc. is exerted on the harness W.

Note, in the above description of the connector according to an embodiment of the present invention, the outer wall surface of the front end of the female connector 1 is provided with an upwardly inclined movable piece 4 and engagement projections 5 and 6, and the grommet 20 is attached to the male connector 10 to be connected to the female connector 1. However, the present invention is not limited to the above embodiment as it is obviously possible to provide the upwardly inclined movable piece and the engagement projections at the outer wall surface of the front end of the male connector 10, and to attach the grommet to the female connector 1 to be connected to the male connector 10.

According to the first embodiment of the present invention, as mentioned above, not only can the female connector 1 be securely attached to the vehicle panel "A" by a simple operation of just inserting the female connector 1 into the hole "a" in the vehicle panel "A", against the spring force of the upwardly inclined movable piece 1 provided in the female connector 1, to thereby engage the engagement projections 5 and 6 with the edges of the hole "a" in the panel "A", but also the opposing male connector 10 can be connected to the female connector 1 with one hand. Thus, work efficiency is remarkably improved. Further, by inserting the male connector 10 into the fitting hole of the female connector 1, to thereby connect the two, any movement of the upwardly inclined movable piece 4 is prevented, and therefore the female connector 1 is securely and firmly fixed to the vehicle panel "A". There is no danger of detaching the female connector 1 from the vehicle panel "A" even if a mechanical tensile force, etc., is exerted on the harness W. Thus, the present invention in the above-discussed embodiment is superior to the conventional connectors used for this purpose.

An explanation will now be made of a second embodiment of the present invention, with reference to the drawings.

Figure 5:
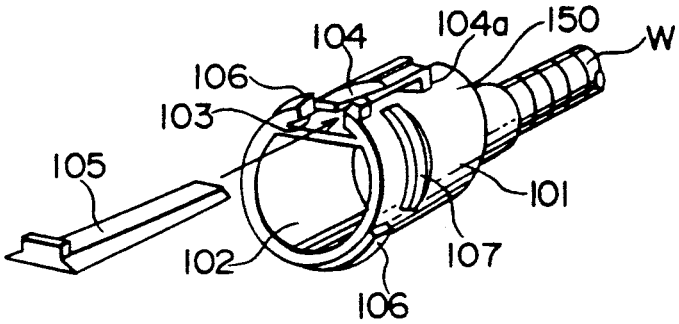
FIG. 5 is a perspective view showing a connector and a locking key according to the second embodiment.
Figure 6:
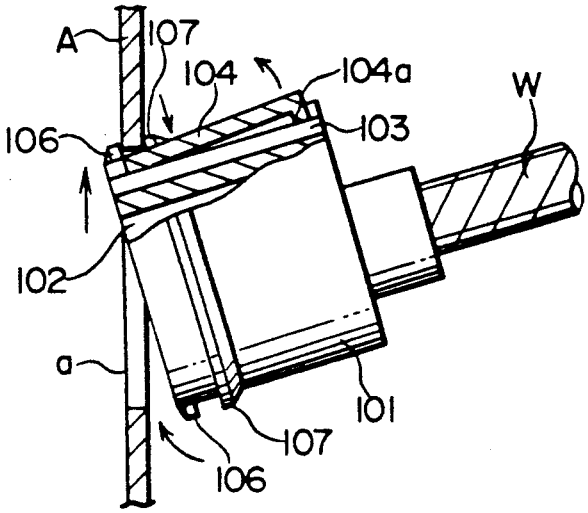
FIG. 6 and FIG. 7 are explanatory views showing the assembly of the connector according to the second embodiment.
Figure 7:
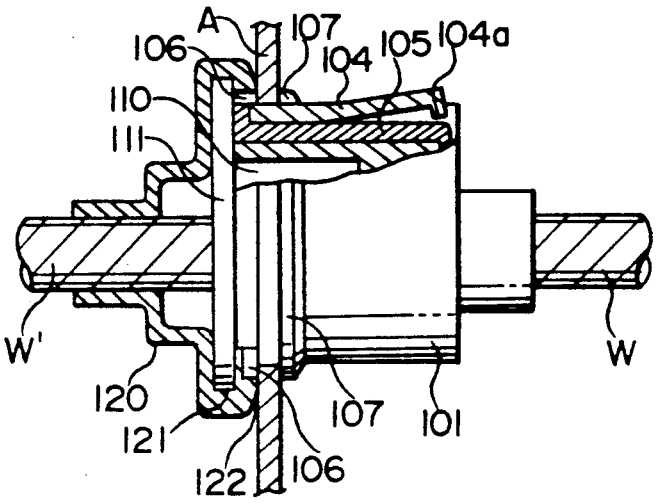

In FIGS. 4 to 7, 101 is a female connector comprised of a connector body 150, 102 is a fitting hole in which the front end of the opposing male connector 110 is fitted, and 103 is a locking key insertion portion separated from the fitting hole 102 by a separating wall as shown in FIG. 5. The top surface of the locking key insertion portion 103, as shown in FIG. 5, is open, and at an approximate center point of the locking key insertion portion 103, a movable piece 104 is pivotally supported in a seesaw manner. The movable piece 104 has a stopper projection 104*a* formed at the base end thereof. Reference numeral 105 denotes a locking key to be inserted into the locking key insertion portion 103. Namely, the locking key 105 is inserted into the locking key insertion portion 103 to prevent any movement of the movable piece 104 after the female connector 101 is attached to the vehicle panel "A". as shown in FIG. 7. Further, when the female connector 101 is not properly attached to the vehicle panel "A", the front end of the locking key 105 abuts against the stopper projection 104*a* provided at the base end of the movable piece 104. Therefore, the locking key 105 cannot be fully inserted into the locking key insertion portion 103, whereby it can be detected that the female connector 101 is not properly attached to the vehicle panel "A". Note, the locking key 105 may be first provisionally engaged with the female connector 101. Reference numerals 106 and 107 denote engagement projections formed at the outer wall surface of the front end of the connector body 150. These engagement projections 106 and 107 are designed in such a manner that they are engaged with the two side edges on both sides of the hole "a" in the vehicle panel "A". The connector body 150, the engagement projections 106 and 107, and the movable piece 104 are formed as a single body from a synthetic resin.

Reference numeral 110 denotes a male connector comprised of a connector body 152 and having a flange portion 111 provided at the outer peripheral surface of the rear end of the connector body 152.

Further, reference numeral 120 denotes a rubber grommet. The rubber grommet 120 is provided with a fitting groove 121 which fits detachably over the flange portion 111 provided at the outer peripheral surface of the top end of the connector body 152. The rubber grommet 120 has a suction cup shaped tight-fitting portion 122 at the front end thereof.

According to the connector of the second embodiment of the present invention, when connecting, for example, a harness W disposed at the passenger compartment side and a harness W' disposed in the engine compartment, the female connector 1 is connected to the terminal end of the harness W disposed in the engine compartment. The female harness is also inclined as shown in FIG. 6 to press the front end of the movable piece 104 into contact with the inside surface of the hole "a" in the vehicle panel "A" to thereby bend the movable piece 104 and force it inside the locking key insertion portion 103. The movable piece 104 can alternatively be manually forced into the locking key insertion portion 103. Accordingly, the engagement projections 106 and 107 are engaged with the two side edges of the hole "a" in the panel "A". Therefore, as shown in FIG. 7, the front end of the movable piece 104 comes into contact with the inside surface of the hole "a" in the vehicle panel "A". Due to the repulsive spring force, the engagement projections 106 and 107 are firmly engaged with the two side edges of the hole "a" in the panel "A".

Next, the locking key 105 is inserted in the locking key insertion portion 103, whereby any movement of the movable piece 104 is prevented, and thus the female connector 101 is securely and firmly fixed to the vehicle panel "A".

If the female connector 101 is not properly attached to the vehicle panel "A", as mentioned earlier, the front end of the lock key 105 abuts against the projections 104*a* provided at the base end of the movable piece 104. Accordingly, the locking key 105 cannot be completely inserted to the lock key insertion portion 103, and thus it can be detected that the female connector 101 is not properly attached to the vehicle panel "A".

When the female connector 101 is attached to the vehicle panel "A" as described above, and then the other male connector 110 is inserted into the female connector 101 to be connected therewith, as shown in FIG. 7, the locking key 105 inserted to the lock keying insertion portion 103 is prevented from being withdrawn by the flange portion 111 of the male connector 110. Therefore, the harness W disposed in the passenger compartment and the harness W' disposed in the engine compartment are electrically connected, and the suction cup shaped tight-fitting portion 122 provided at the front end of the grommet 120 fitted to the male connector 110 is tightly adhered to the vehicle panel "A". This in turn completely prevents the entry of noise, rain water, and dust, etc., from the engine compartment to the passenger compartment of the vehicle.

Note, in the above description of a connector according to a second embodiment of the invention, the female connector 101 attached to the vehicle panel "A" is provided with a locking key insertion portion 103 and a movable piece 104 supported pivotally in a seesaw manner at an approximate center of the locking key insertion portion 103. The movable piece 104 has a projection 104*a* formed at the base end thereof, and a locking key 105 is provided to be inserted into the locking key insertion portion 103. However, the present invention is not limited to the above embodiment. Among other modifications the connector may be constructed so that the male connector 110 is attached to the vehicle panel "A" and is provided with a locking key insertion portion for insertion of a locking key. The movable piece can be supported in a seesaw manner at the approximate center portion of the locking key insertion portion with projections formed at the base end thereof. The grommet can be attached to the female connector 101 to be connected to the male connector 110.

Figure 8:
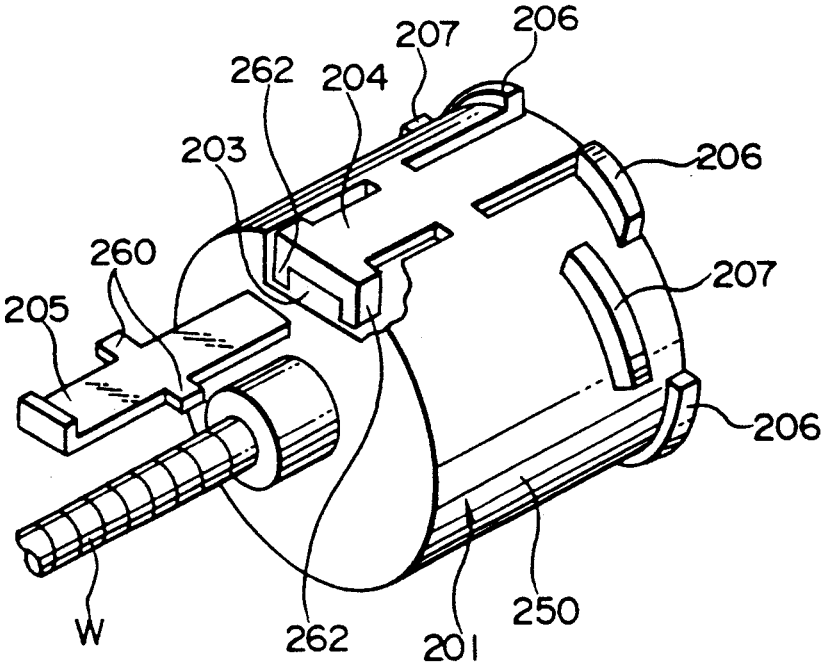
FIGS. 8 and 9 are perspective views showing a connector and a locking key according to another embodiment of the present invention.
Figure 9:
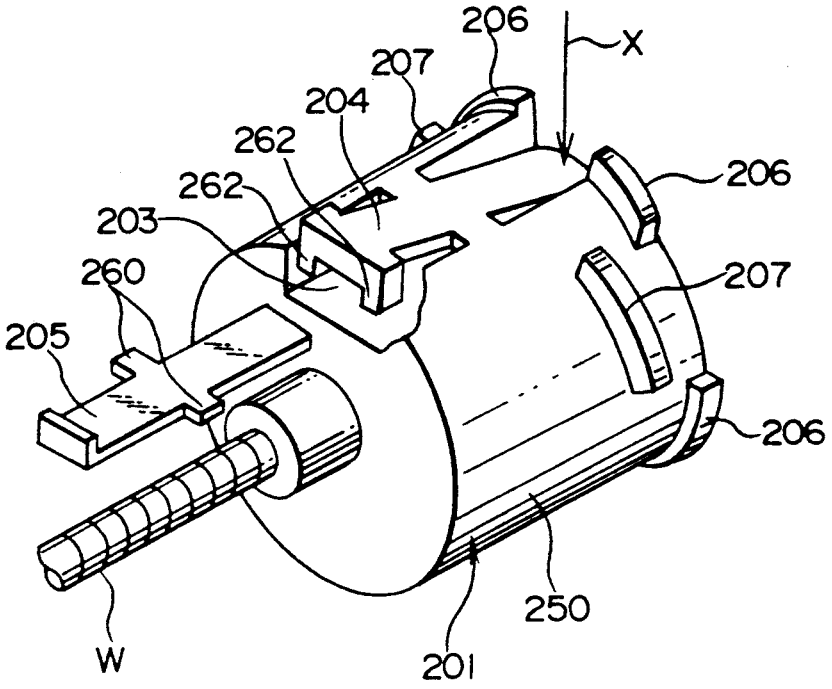

FIGS. 8 and 9 show another embodiment, which is a modification of the above-described embodiment shown in FIGS. 4 to 7.

In this embodiment, a locking key insertion portion 203 is formed at the rear end of a connector body 250 of a female connector 201 and a locking key 205 is inserted to the insertion portion 203 from the end of the connector body 250 to which a harness W is attached. The locking key 250 is provided with first engagement projections 260 which project laterally from both sides of the locking key 205 and are engaged with a movable piece 204 when the locking key 205 is inserted to the connector body 250. The movable piece 204 is formed at the outer surface of the connector body 250 and is located over the insertion portion 203. The movable piece 204 is pivotally mounted in a seesaw manner at an approximate center of the insertion portion 203. A pair of second engagement projections 262 are provided at the rear end of the movable piece 204, and project downward from the sides of the rear end of the movable piece 204. The second engagement projections 262 engage with the first engagement projections 260 of the lock key 205 to thereby prevent a detaching of the locking key 205 from the insertion portion 203, after the locking key 205 is fully inserted to the insertion portion 203.

Engagement projections 206 and 207 are formed at the peripheral surface of the front end of the connector body 250. These engagement projections 206 and 207 are separated from each other by a predetermined distance in an axial direction of the connector body 250, so that the side edges of a hole in a vehicle panel are fitted between the projections 206 and 207.

As shown in FIG. 9, when the outer surface of the front end of the connector body 250 is pressed into contact with the inside surface of the hole in the vehicle panel (not shown), the front end of the movable piece 204 is pressed down and the rear end of the movable piece 204 is lifted upward, to thus open the entrance to the insertion portion 203. Thereafter, the locking key 205 is inserted into the insertion portion 203. After the locking key 205 is fully inserted to the insertion portion 203, the front end of the movable piece 204 is lifted up and brought into tight contact with the inside surface of the hole in the vehicle panel. Accordingly, the engagement projections 206 and 207 are firmly engaged with the hole. Further, the first engagement projections 260 of the locking key 205 are engaged with the second engagement projections 262 of the movable piece 204, and thus the locking key 205 cannot be easily detached from the insertion portion 203.

FIGS. 10 to 13 show another embodiment, which is a modification of the above-described embodiment shown in FIGS. 4 to 7.

Figure 10:
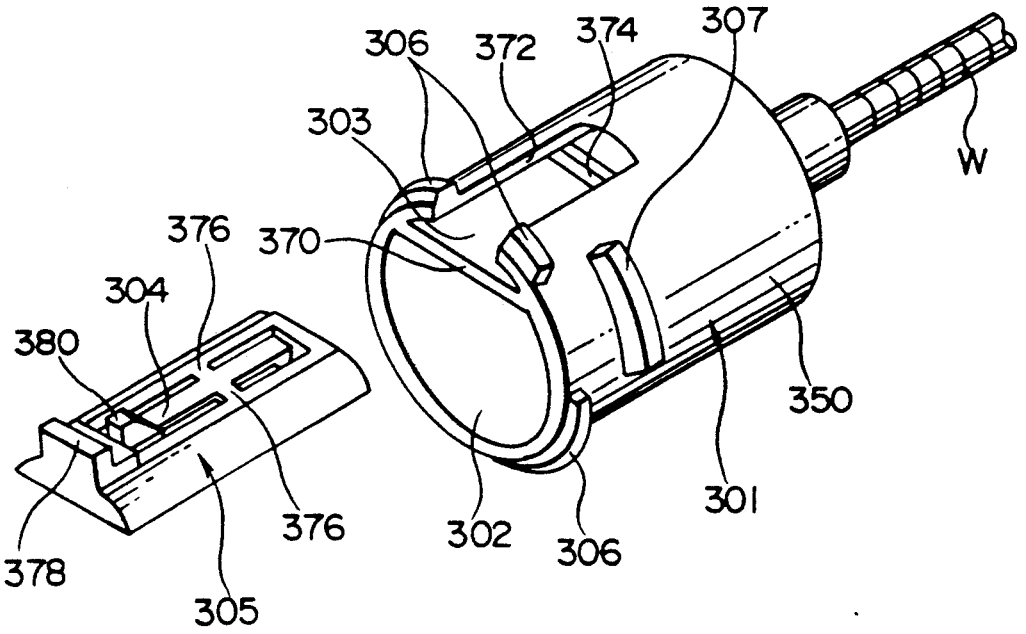
FIG. 10 is a perspective views showing a connector and a locking key according to a further embodiment of the present invention.

In this embodiment, as shown in FIG. 10, a movable piece 304 is attached to a locking key 305, the movable piece 304 being pivotally supported by supporting pieces 376 in a seesaw manner at the approximate center of the locking key 305. The locking key 305, the supporting pieces 376, and the movable piece 304 are formed as one body.

A locking key insertion portion 303 is formed at the front end of a connector body 350 of a female connector 301, and is separated from a fitting hole 302 by a separating wall 370. The locking key insertion portion 303 is provided with an aperture 372 at the top surface thereof, to allow the movable piece 304 of the locking key 305 to be exposed at the outer surface of the connector body 350 when the locking key 305 is fitted into the insertion portion 303.

Engagement projections 306 and 307 are formed at the peripheral surface of the front end of the connector body 350, and an inside surface of a hole in a vehicle panel (not shown) is engaged between these projections 306 and 307. The insertion portion 303 is provided with a stopper projection 374 on the separating wall 370. The function of the stopper projection 374 will be explained later.

Figure 11:
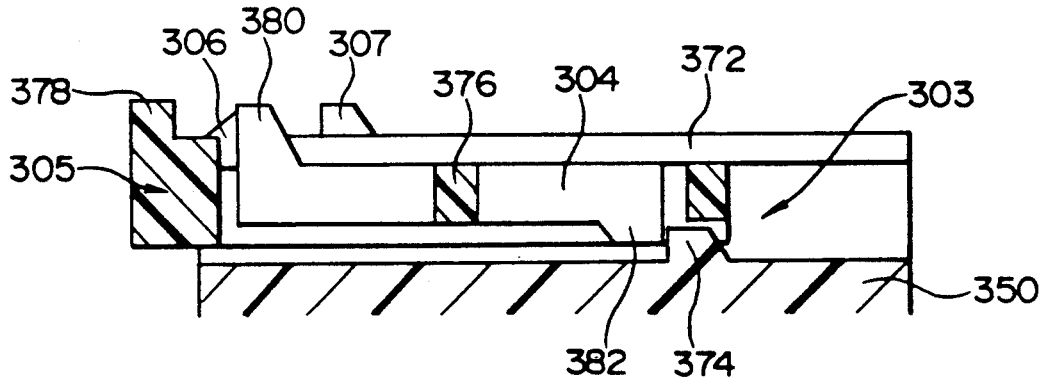
FIGS. 11, 12, and 13 are partial sectional views showing an attaching operation of the connector shown in FIG. 10.

The locking key 305 is provided with a first upper engagement projection 378 at the base end thereof, and the movable piece 304 is provided with a second upper engagement projection 380 at the base end thereof and a lower engagement projection 382 at the tip end thereof, as shown in FIG. 11.

Figure 12:
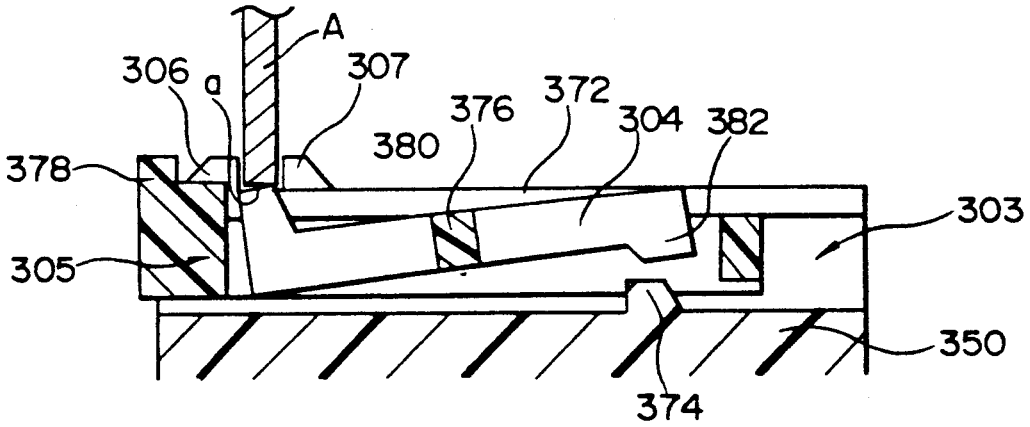
Figure 13:
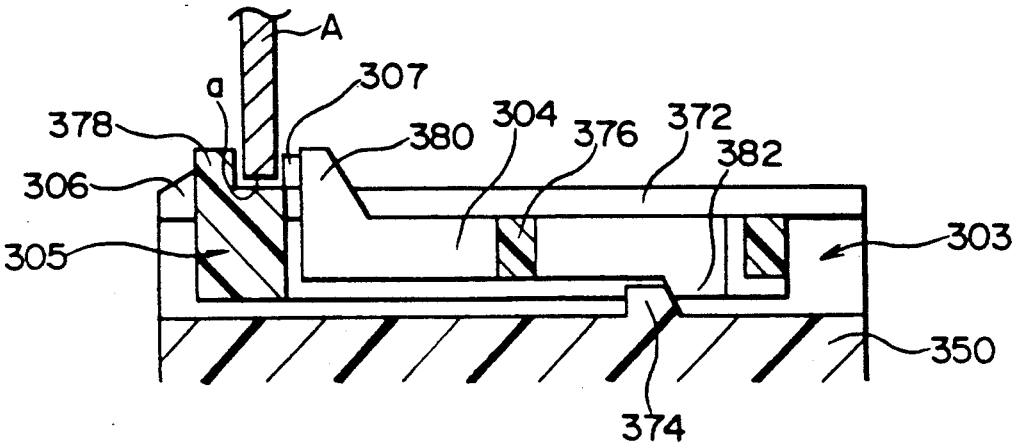

When the female connector 301 is attached to a vehicle panel, the locking key 305 is first partially inserted to the insertion portion 303 of the connection body 350, as shown in FIG. 11. Then, as shown in FIG. 12, the front end of the connector body 350 with the locking key 305 is inserted into the hole "a" in the vehicle panel "A". Accordingly, the upper engagement projection 380 of the movable piece 304 is brought into contact with the inner surface of the hole "a" and pressed down. Therefore, the movable piece 304 is pivoted around the supporting piece 376, as a pivotal center, whereby the lower engagement projection 382 is lifted up. In this state, the locking key 305 can be fully inserted to the insertion portion 303 as shown in FIG. 13. After the locking key 305 is fully inserted into the insertion portion 303, the upper engagement projection 380 is disengaged from the inner surface of the hole "a" in the panel A and is pushed up by the repulsion spring force thereof, and therefore, the lower engagement projection 382 is pivoted down and engaged with the stopper projection 374. Thus, the locking key 305 can not be easily detached from the insertion portion 303. In this state, the engagement projections 306 and 307 of the connection body 350 are engaged with the two side edges of the hole "a". Further, the first and second upper engagement projection 378 and 380 are engaged with the two side edges of the hole "a" in the panel A. Accordingly, the connector 301 can not be easily detached from the vehicle panel "A" once it is attached thereto.

Figure 14:
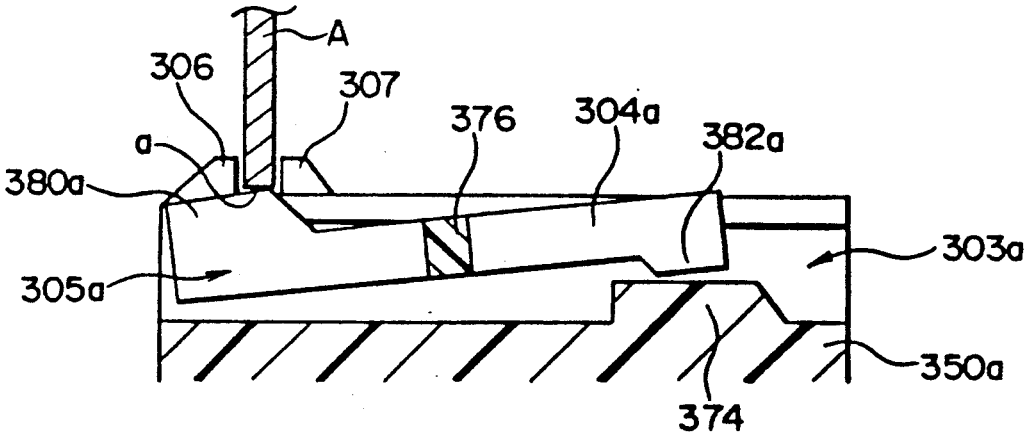
FIG. 14 is a sectional views showing a portion of a connector according to a further embodiment of the present invention.
Figure 15:
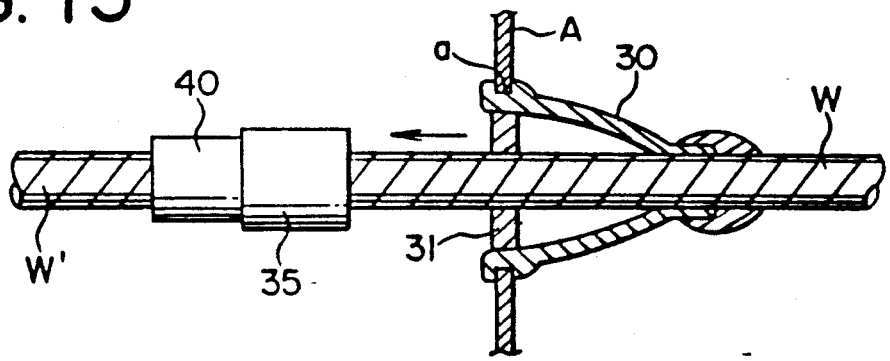
FIG. 15 PRIOR ART
FIG. 15 and FIG. 16 are explanatory views showing the assembly of conventional connectors with grommets.
Figure 16:
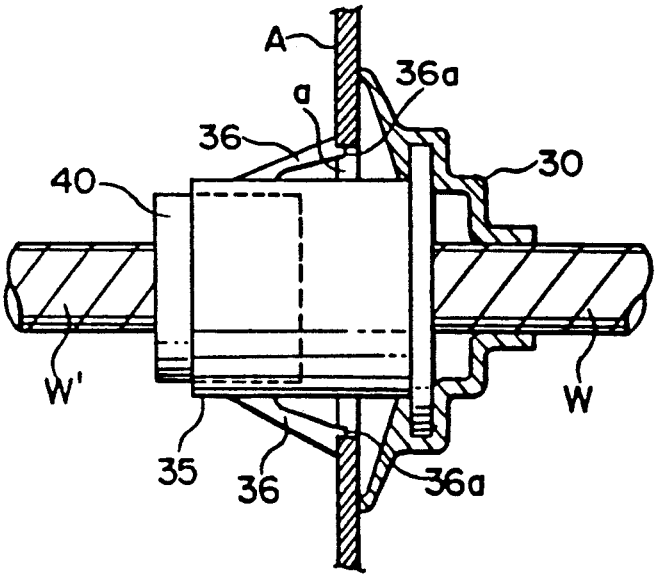
FIG. 16 PRIOR ART

FIG. 14 shows an another embodiment, which is a modification of the embodiment shown in FIGS. 10 to 13.

In this embodiment, when a locking key **305*a* is fully inserted to a locking key insertion portion 303*a* of a connector body 350*a*, an upper engagement projection 380*a* is brought into contact with an inner surface of a hole "a" in a vehicle panel "A", due to the repulsion spring force of a movable piece 304*a*. Thus, engagement projections 306 and 307 of the connector body 350*a* are tightly engaged with both sides of the two side edges of the hole "a" in the panel "A". At this stage, a lower projection 382*a* is located over a projection 374*a* formed in the insertion portion 303*a***.

According the embodiments of the present invention described above, it is possible to securely and firmly attach the female connector (or male connector) to the vehicle panel, and it is possible to detect, by the position of the locking key, whether the female connector (or male connector) is properly attached to the vehicle panel "A". Also, by connecting the other connector (female or male connector), the locking key cannot be pulled out. Thus, there is no danger of a detaching of the connector from the vehicle panel even if a mechanical tensile force, etc. is exerted on the connector.

Further, the connectors can be connected simply and swiftly with one hand, and when the connectors are connected, the suction cup shaped tight-fitting portion provided at the front end of the grommet is tightly fitted into the vehicle panel, and thus a great advantage is obtained in that it is possible to completely prevent the entry of noise, rain water, and dust, etc., from the engine compartment to the passenger compartment of the vehicle.

Many widely different embodiments of the present invention may be constructed without departing from the spirit and scope of the present invention, and it should be understood that the present invention is not restricted to the specific embodiments described above.

We claim:

1. A connector for wiring in a vehicle comprising:

a connector body consisting of one of a male and female connector attached to a terminal end of a harness;

first engagement projections formed discontinuously in a peripheral direction at an outer wall surface of an insertable tip end of said connector body and engageable with a first side edge of a hole in a vehicle panel;

a second engagement projection formed at an outer wall surface of said connector body in a longitudinally different and peripherally complementary position relative to said first engagement projections and engageable with a second side edge of the hole in the vehicle panel;

a resiliently movable piece formed at an outer wall surface of said connector body and pressed into contact with an inside surface of the hole in the vehicle panel, said movable piece being formed substantially as a narrow arm extending longitudinally parallel to said connector body;

a locking key insertion portion formed on the outer wall surface of said connector body under said movable piece, said locking key insertion portion having defined therein a recess positioned longitudinally relative to said connector body, said movable piece being positioned so as to be parallel to the recess; and a locking key removably insertable into a front end of the recess of said locking key insertion portion to thereby lock said movable piece and maintain said movable piece in contact with the hole in the vehicle panel, said locking key being formed as a narrow bar, two of said first engagement projections being positioned at both sides of said movable piece and another of said first engagement projections being positioned at an opposite side of said movable piece;

wherein said movable piece is pivotally supported in a seesaw manner at an approximate center of the recess of said locking key insertion portion.

2. A connector for wiring in a vehicle as set forth in claim 1, wherein said movable piece is provided with a stopper projection formed at a base end thereof such that a front end of said locking key is abutted against the stopper projection when the connector is not properly attached to the vehicle panel.

3. A connector for wiring in a vehicle as set forth in claim 1, wherein a grommet formed by a rubber grommet piece is attached to a periphery of at lest one of said connector body and a corresponding complementary connector body to be electrically connected thereto.

4. A connector for wiring in a vehicle as set forth in claim 1, wherein said connector body, said engagement projections, said movable piece, and said locking key insertion portion are formed as one body from a synthetic resin.

5. A connector for wiring in a vehicle as set forth in claim 1, wherein said movable piece has a repulsion spring force by which said movable piece is pressed into contact with the inside surface of the hole in the vehicle panel, to thereby engage said engagement projections with said hole in said vehicle panel.

6. A connector for wiring in a vehicle, comprising:

a connector body consisting of one of a male and female connector attached to a terminal end of a harness;

first engagement projections formed discontinuously in a peripheral direction at an outer wall surface of an insertable tip end of said connector body and engageable with a first side edge of a hole in a vehicle panel;

a second engagement projection formed at an outer wall surface of said connector body in a longitudinally different and peripherally complementary position relative to said first engagement projections and engageable with a second side edge of the hole in the vehicle panel; and locking means including a resiliently movable piece means for engaging with the hole in the vehicle panel so as to engage said engagement projections with the hole in the vehicle panel, said movable piece means being formed substantially as a narrow arm extending longitudinally parallel to said connector body, and a locking key removably insertable longitudinally parallel to said connector body into a front end thereof between the movable piece means and said connector body to thereby lock and maintain said movable piece means in contact with the hole in the vehicle panel, said locking key being formed as a narrow bar, wherein two of said first engagement projections are positioned at both sides of said movable piece means and another of said first engagement projections is positioned at an opposite side of said movable piece means, and wherein said movable piece is pivotally supported in a seesaw manner at an approximate center of the recess of said locking key insertion portion.

* * * * *